US005525177A

United States Patent [19]

Ross

[11] Patent Number: 5,525,177

[45] Date of Patent: Jun. 11, 1996

[54] IMAGE TRANSFER METHOD FOR ONE WAY VISION DISPLAY PANEL

[75] Inventor: Gregory E. Ross, Santa Rosa, Calif.

[73] Assignee: Clear Focus Imaging, Inc., Santa Rosa, Calif.

[21] Appl. No.: 299,500

[22] Filed: Sep. 1, 1994

[51] Int. Cl.[6] ..... B44C 3/02

[52] U.S. Cl. ..... 156/240; 156/230; 156/235; 156/277; 156/249; 40/615; 40/591

[58] Field of Search ..... 156/230, 71, 235, 156/247, 249, 277, 239, 240; 40/588, 615, 589, 591

[56] References Cited

U.S. PATENT DOCUMENTS

| | | | |
|---|---|---|---|
| 3,451,877 | 6/1969 | Herschman | 161/3 |
| 3,853,675 | 12/1974 | Edwards | 161/3 |
| 4,070,781 | 1/1978 | Saver | 40/591 X |
| 4,358,488 | 11/1982 | Dunklin et al. | 428/31 |
| 4,440,590 | 4/1984 | Collins et al. | 156/235 X |
| 4,673,609 | 6/1987 | Hill | 428/187 |
| 4,940,622 | 7/1990 | Leavitt, Sr. | 428/137 |

FOREIGN PATENT DOCUMENTS

| | | | |
|---|---|---|---|
| 0094845 | 11/1983 | European Pat. Off. | 156/240 |
| 0041989 | 3/1982 | Japan | 156/277 |
| 2118096 | 10/1983 | United Kingdom . | |
| 9102296 | 2/1991 | WIPO | 156/240 |

*Primary Examiner*—David A. Simmons
*Assistant Examiner*—Steven J. Helmer
*Attorney, Agent, or Firm*—Feix & Feix

[57] ABSTRACT

A method of producing an image onto a surface of a one-way vision display panel of the type which is constructed as a perforated membrane having an opaque light-reflective surface and a light-absorbing surface and whereby the image is clearly visible when viewing the display panel from one direction and wherein the perforated membrane permits substantially unobstructed through-viewing when viewing the display panel from a second, opposite direction. The method substantially eliminates the corona effect of the image while viewing the display panel in the through-viewing direction, the corona effect being the result of stray ink which has traveled from the image layer into the through-holes of the perforated membrane during the image printing process. The method includes the steps of: electrostatically transferring ink onto a transfer medium as a reverse image for temporarily holding the reverse image for later transfer to a surface of a perforated membrane; and transferring the reverse image from the transfer medium using heat and/or pressure in order to form a desired correctly oriented image onto only the solid bar portions of a surface of a perforated membrane without any substantial image transfer into or through the through-holes of the perforated membrane such that the correctly oriented image is substantially undetectable when looking at the one-way vision display panel in the second, opposite through-viewing direction.

16 Claims, 5 Drawing Sheets

IMAGE TRANSFER METHOD FOR ONE WAY VISION DISPLAY PANEL

BACKGROUND OF THE INVENTION

The present invention relates to improvements in one-way vision display panels of the kind constructed from perforated plastic sheet material and which include an image or pattern which is only visible when the display panel is viewed from one direction and wherein the display panel permits substantially unobstructed through-viewing when viewed from the opposite direction. More particularly, the invention relates to a method for transferring a printed image onto a display surface of the perforated membrane material in such a manner whereby the through-viewing capability of the one-way vision display panel is not adversely effected.

One-way vision display panels of the type which are constructed from plastic film material and contain a printed image which is visible when viewed from one direction and which appears transparent when viewed from a second, opposite direction are known from the prior art. Such one-way vision display panels are advantageously used in advertising since they may be easily applied to and displayed on any smooth transparent surface, such as the windows of buildings, buses, streetcars, trucks and the like.

In accordance with conventional one-way vision display panel design, the display image is formed as a pattern of two-color opaque dots which are applied by screen, litho or similar printing process along an interface surface between two adjoining transparent plastic panels. The opaque dots appear white or light in color on one side and black on the other. Light incident on the light color side of the panel is scattered and reflected thereby permitting an image formed by the dot pattern to be seen when viewed from this direction. Light incident on the opposite or black side of the panel is absorbed such that the light transmitted through the transparent portions of panel permit through-viewing in the direction from the black color side to the light color side.

A one-way vision display panel constructed as a perforated plastic panel or membrane having a black rear surface and a white opaque front surface offers superior optical through-vision properties as compared to the conventional one-way vision display panels of the prior art mentioned at the outset. The reason for this is that fewer optical losses due to diffraction and refraction are experienced when light is transmitted virtually unobstructed through the holes of the perforated plastic film material as compared to when light is transmitted through the numerous transparent plastic and adhesive layers of the prior art one-way vision panels.

A problem arises, however, when using conventional printing processes, such as liquid ink silk screen, litho or similar inking processes, for printing an image or pattern on the white opaque front side surface of a perforated plastic panel or membrane. The ink used in any of these conventional inking processes has a tendency to travel or bleed into the outer and upper perimeter of the holes of the perforated plastic membrane thereby making the image printed on the opaque white side visible from the rear or black side. This means that when looking from behind the panel (i.e. when looking into the rear or black side for viewing through the panel) the presence of the ink in the side walls of the holes creates a corona effect, i.e. the ink in the holes gives rise to an undesirable halo or phantom image which is seen when viewing the display panel from behind, i.e. in the through-viewing direction.

Accordingly, there is a definite need in the art for a method of accurately printing an image onto a surface of a one-way vision display panel constructed as a perforated plastic panel or membrane which overcomes the problems of the prior art.

SUMMARY OF THE INVENTION

The present invention is directed to methods and apparatus for accurately printing a color image or pattern onto a surface of a one-way vision display panel of the type constructed as a perforated plastic panel or membrane without any substantial image transfer into or through the through-holes of the perforated plastic panel or membrane.

It is a specific object of the invention to provide an image transfer method whereby the transferred image is not detectable when looking at the one-way vision display panel from behind the panel, i.e. in the through-viewing direction.

In accordance with a preferred implementation of the invention, the one-way vision display panel onto which an image is transferred comprises an assembly of two or more plastic panels, one of which has a light-reflective coating suitable for receiving a printed image thereon and which is preferably opaque white in color. The other panel has a light-absorbing coating which is preferably black in color. The panels are bonded together by an adhesive and then are provided with holes therethrough. The holes can be placed through the panels either before or after they are assembled. Typically, the holes are formed after the panels have been assembled. The holes are preferably ordered in staggered or offset columns and rows such that they provide about a 50% open area for effective light transmission through the panel assembly.

In a first alternate implementation of the image transfer method of the invention, the one-way vision display panel comprises a single plastic sheet or membrane having opposite sides provided with light-reflective and light-absorbing color coatings, respectively. This "double coated" panel is then perforated with a plurality of through-holes as described above.

The purpose of the holes is to allow viewing through the image display panel assembly in one direction without seeing an image which is subsequently printed onto the light-reflective panel (in the case of the multi-panel embodiment) or the light-reflective coating side (in the case of the double coated single panel embodiment), yet the image can be viewed by looking at the image display panel assembly from the opposite direction. Thus, the image is suitable as an advertising medium as applied to the transparent windows of buildings, vehicles and the like. A person sitting in a building or in a vehicle cannot see the image on a window by looking outwardly through the window. Looking in the opposite direction, however, (i.e. looking into the window and image display panel from the outside of the building or vehicle) a person will see the image.

In accordance with the method aspects of the invention, a reverse image is first placed onto a specially prepared substrate or transfer medium. In a preferred embodiment, the substrate or transfer medium comprises paper sheet stock. Toner or powered ink is then deposited on the paper in reverse image in accordance with the known electrostatic printing process. The paper is treated with a conventional toner receptive coating so that the ink or toner in either powder or liquid form will remain intact on the paper without smudging or smearing so long as the paper is handled with reasonable care. In addition to paper, the transfer medium may also comprise vinyl, or any other suitable substrate, preferably plastic sheet material, which is capable of holding an image from an electrostatic printing mechanism.

The transfer medium with the reverse image printed thereon is then fed into a laminator along with the perforated plastic panel or membrane. The laminator is used for transferring the reverse image initially printed on the transfer medium as a permanent image on a surface of the perforated plastic panel or membrane, the transferred or permanent image being oriented as a mirror image of the reverse image in a desired orientation. In the case where the image is printed text, the transferred image is oriented as a readable text image. The laminator uses heat and pressure to affect image transfer.

In one embodiment, the laminator comprises a pair of heated rollers. The transfer medium is fed into the heated rollers, image side down, along with the perforated plastic panel or membrane which is inserted from below with the opaque white surface facing upwards so that the image is transferred across to only the solid bar portions of the opaque white surface of the perforated membrane. Those portions of the reverse image overlying the holes contained in the perforated plastic panel or membrane will remain on the transfer medium and will not penetrate into or through the holes of the perforated plastic panel or membrane. Upon exiting the rollers, the transfer medium along with the untransferred ink portions is then peeled away for disposal.

It is an advantageous feature of the method of the present invention that the image is accurately and rapidly transferred onto only the solid bar portions of the transfer surface of the perforated plastic panel or membrane through the use of well known printing processes without any substantial image transfer into or through the holes of the perforated plastic panel or membrane. In this way, an undesirable ghost or phantom image of the true image can not readily be seen when viewing the one-way vision image display panel from the darkened back side, i.e. in the through-viewing direction.

Another advantageous feature of the invention is that the image transfer method may be used to transfer an image onto a surface of a perforated membrane for use as either an exterior mount or an interior mount image display panel. In the case of an interior mount panel (for example, a panel which is applied to inside surface of store window, and wherein the image is visible when looking through the store window from the outside) the image is protected from vandalism or graffiti.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 shows a one-way vision display panel constructed as a perforated plastic panel as it is being applied to a surface of a window. The perforated plastic panel is shown with an image surface containing in print form the word "SALE" thereon.

FIGS. 2A–2B is a two-part series of enlarged fragmentary section views of the portion of the perforated plastic panel of FIG. 1 shown encircled by arrow 2A,B in FIG. 1. The two-part series shows a comparison between a perforated plastic panel having an image layer applied in accordance with a prior art silk screen printing process (FIG. 2A) and a perforated plastic panel having an image layer applied in accordance with the image transfer process of the present invention (FIG. 2B).

DETAILED DESCRIPTION OF THE PREFERRED EMBODIMENTS

Figure 1:
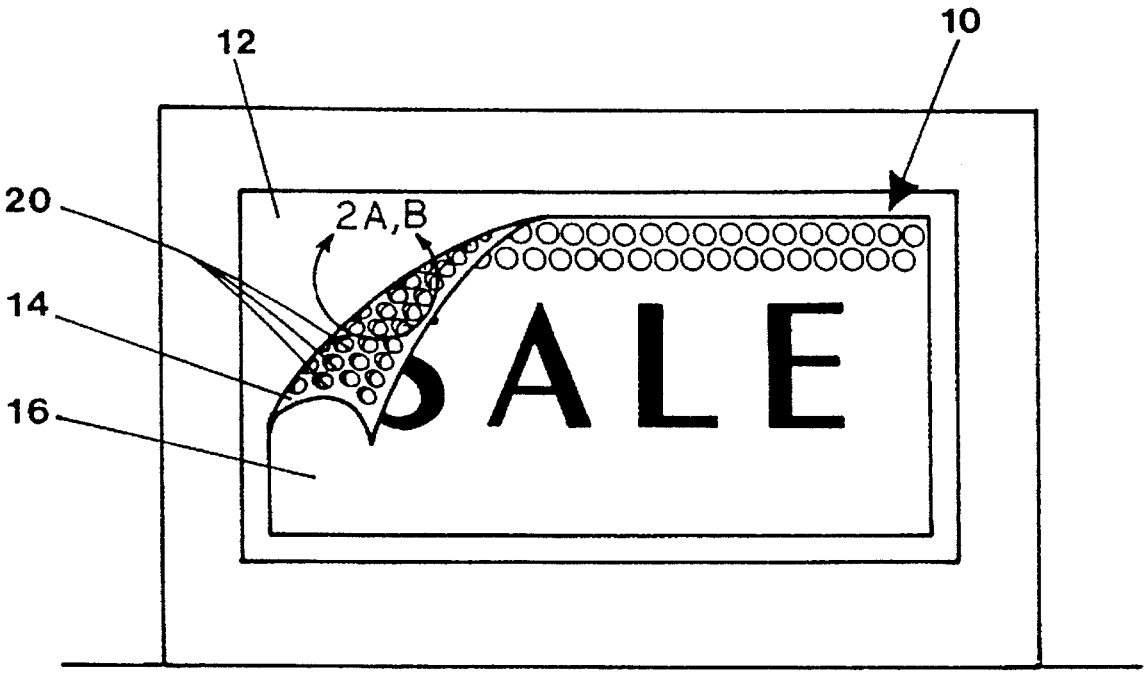

FIG. 1 is a front elevational view of an exemplary one-way vision image display panel 10 of the type constructed as a perforated plastic sheet material or membrane and which is shown being applied to a surface of a window 12. The one-way vision panel 10 includes a first, light-absorbing layer or surface coating 14, preferably black in color, and a second, light-reflective layer or surface coating 16, preferably opaque and white in color. A printed image 18 of the word "SALE" is shown printed on the light-reflective layer 16.

The one-way vision display panel 10 shown is commonly referred to in the art as an "exterior mount" panel since, in use, the panel 10 is applied to the exterior or outer surface of a window on a building or bus, etc., and the image 18 is only seen by a person when looking through the window from a position outside the outside of the window. In an exterior mount panel, the light-absorbing or black layer 14 is the "rear" layer or surface and is oriented adjacent the window's exterior surface while the light-reflective layer 16 is the "front" layer or surface as it is the outermost surface of the panel 10.

The display panel 10 is perforated with a plurality of through-holes 20 which extend completely through the panel 10 from the inner light-absorbing layer 14 to the outer light-reflective layer 16. The through-holes 20 allow viewing through the panel 10 in a direction looking through the window 12 from a position inside of or behind the window 12 without seeing the image 18 which is printed on the light-reflective surface 16, yet the image 18 can be viewed by looking at the panel 10 from the opposite direction (i.e. towards the light-reflective surface 16 from a position outside the window 12). The panel 10 may be adhered to the window 12 by an adhesive layer (not shown) which preferably attaches only the solid bar portions of the perforated plastic material to the window so as not to cover up the holes 20 and thereby detract from the optical clarity when viewing through the panel in the direction from the light-absorbing layer 14 to the light-reflective layer 16. Alternately, the panel 10 may comprise static cling material for adhering the panel 10 directly to the window 12 without need for an intermediate adhesive layer.

Figure 2A:
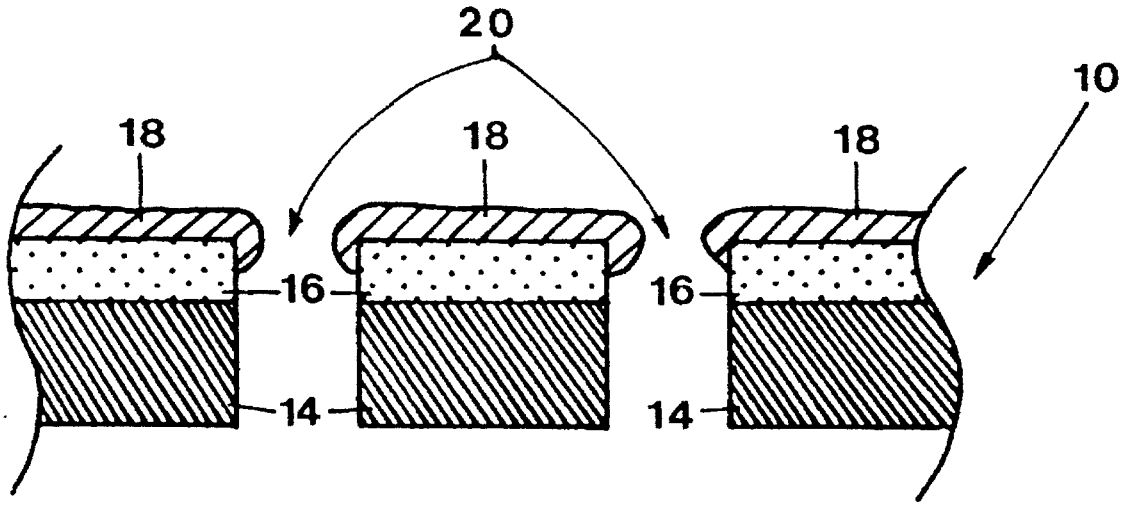
FIG. 2A (PRIOR ART)
Figure 2B:
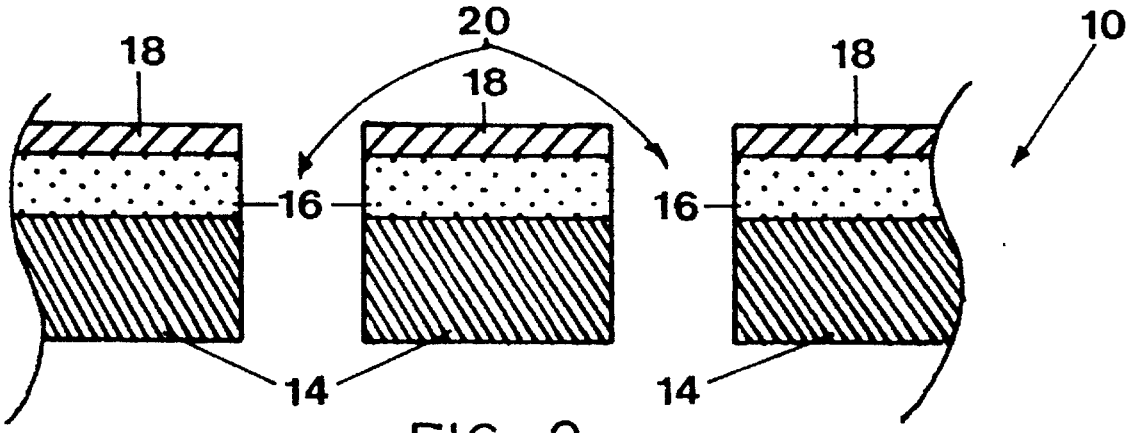

FIGS. 2A–2B is a two-part series of section views through the portion of the perforated plastic panel 10 of FIG. 1 shown encircled by arrow 2A,B in FIG. 1. This two-part series of drawing views is useful for illustrating the difference between a perforated plastic panel having an image applied to one surface thereof using a conventional ink printing process (FIG. 2A) and a perforated plastic panel having an image applied to a surface thereof by the image transfer method of the present invention (FIG. 2B).

In FIG. 2A there is shown a perforated plastic panel 10 comprising a dark, light-absorbing layer 14, an opaque white light-reflective layer 16, and an image layer 18 which has been applied to the opaque white light-reflective layer in accordance with a prior art silk screen printing process, or similar liquid ink printing process. Note how the ink of the image layer 18 tends to spill over into the upper perimeter of the through-holes 20. This creates an undesirable ghost or phantom image effect which can be seen when viewing the image display panel in the through-viewing direction, e.g., when looking outside through a building or bus window having a one-way image display panel thereon.

FIG. 2B shows an image layer 18 which has been applied to the opaque white, light-reflective layer 16 in accordance with the image transfer method of the present invention. Note how substantially no portion of the image layer 18 penetrates into or through the through-holes 20 of the perforated plastic panel 10.

Figure 3:
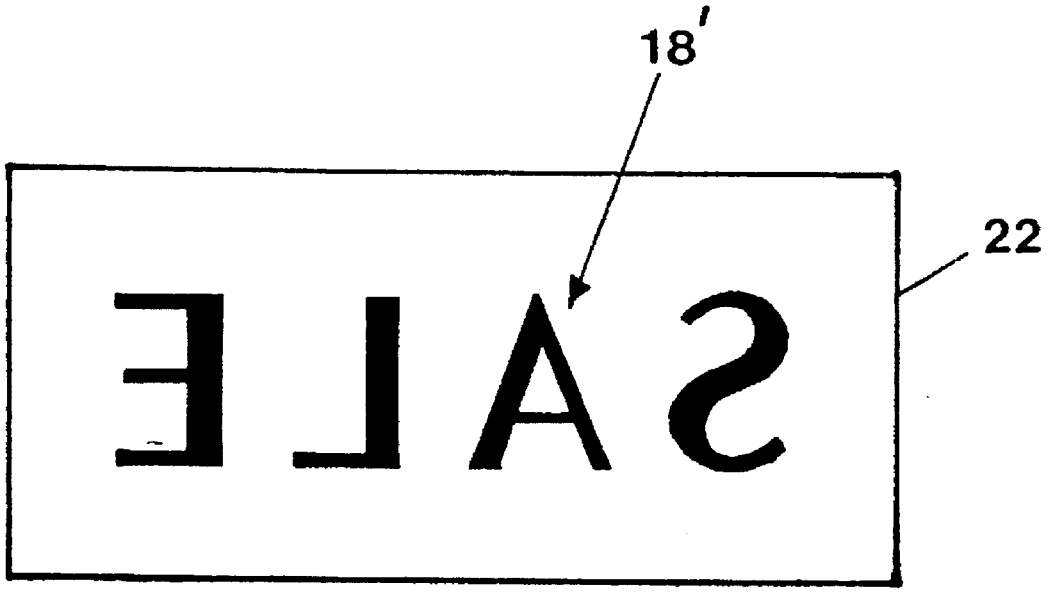
FIG. 3 is a front elevational view of a reverse image deposited onto a transfer sheet which is used for temporarily holding the reverse image for subsequent transfer as a desired correctly oriented image onto a surface of a perforated plastic panel.

The image transfer process of the present invention will be explained in more detail with reference to FIGS. 3–6. In FIG. 3 there is shown a transfer medium 22, preferably a paper sheet, which is used for temporarily holding an image 18' for subsequent transfer to a surface of a perforated plastic panel or membrane. In the example shown, the image 18' is the word "SALE" printed in reverse image. The reverse image 18' has been produced using a conventional electrostatic powder ink transfer process or similar electrostatic liquid ink coating process. The reverse image 18' will stay intact on the paper 22 and will not smudge or smear so long as the paper it is handled with reasonable care, i.e. by its edges such that the image 18' is not subjected to any direct physically touching or rubbing by a user.

Figure 4:
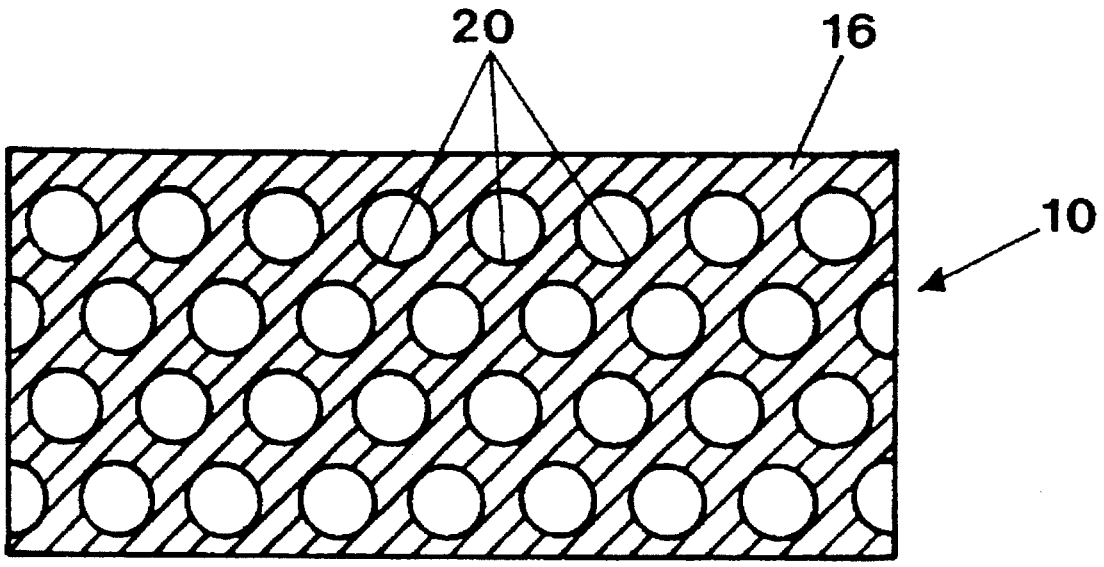
FIG. 4 is a front elevational view of a perforated plastic panel shown before an image has been printed or transferred thereon.

FIG. 4 shows a plastic panel 10 which has been perforated with a plurality of small through-holes 20 and which is provided with an upper surface or layer 16 which is suitable for printing or imaging. Preferably, the upper surface or layer 16 is an opaque white, light-reflective coating or layer.

Figure 5:
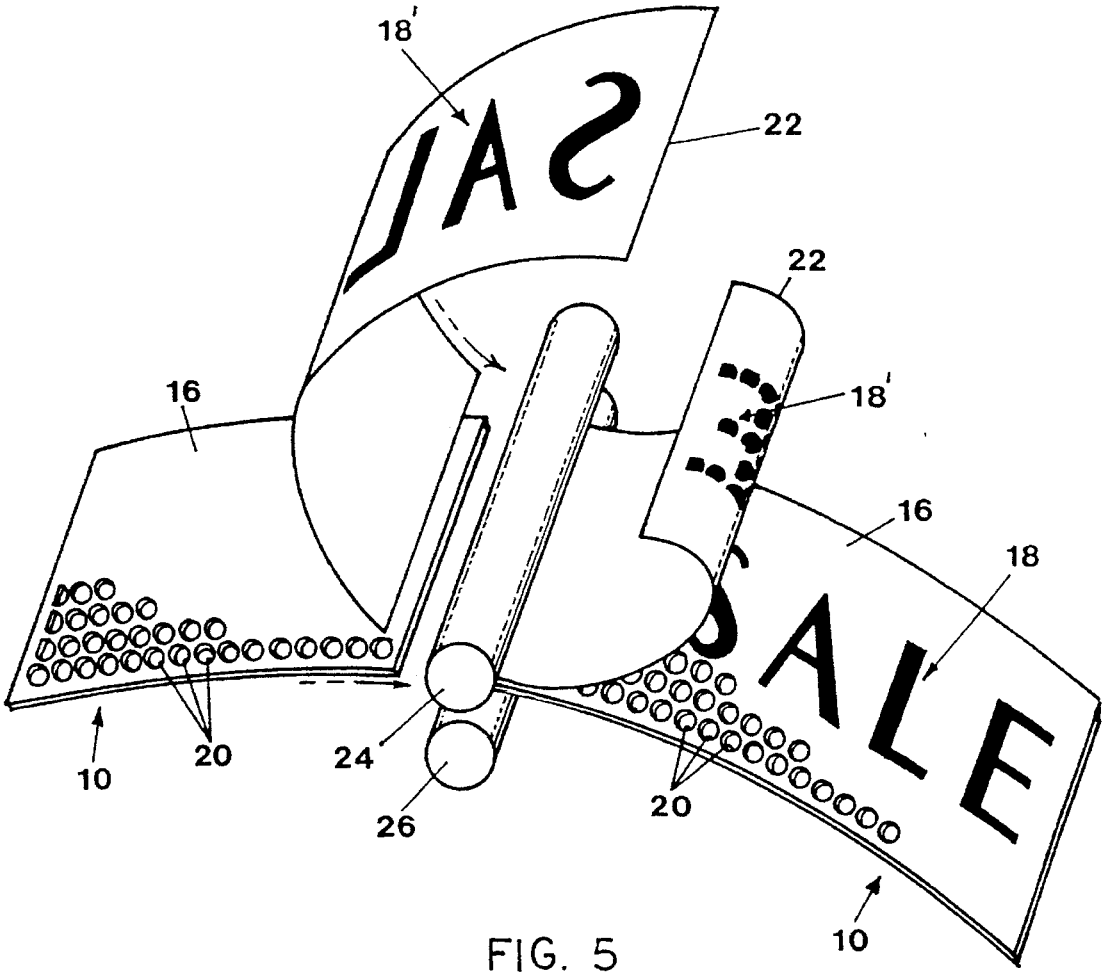
FIG. 5 is a perspective view which illustrates the process of transferring a reverse image from the transfer sheet to a surface of the perforated plastic panel.

FIG. 5 shows a typical laminating process whereby two rollers 24, 26, typically heated and under pressure, are used to transfer the reverse image 18' from the transfer medium or transfer sheet 22 onto the print ready upper surface or layer 16 of the perforated plastic panel 10. This is done by feeding the transfer medium 22 and perforated plastic panel 10 into the rollers 24, 26 such that the reverse image 18' of the transfer medium 22 faces the print ready upper layer or surface 16 of the perforated plastic panel 10. The transfer medium 22 and perforated plastic panel 10 are then rolled through the heated pressure rollers in the manner as shown. This causes the reverse image 18' to be transferred as a permanent image 18 in a desired readable orientation onto only the solid bar portions of the upper surface or layer 16 of the perforated plastic panel 10. Those portions of the reverse image 18 which overlie the through-holes 20 during the laminating process will remain on the transfer medium 22 and will not penetrate into or through the through-holes of the perforated plastic panel 10.

Figure 6:
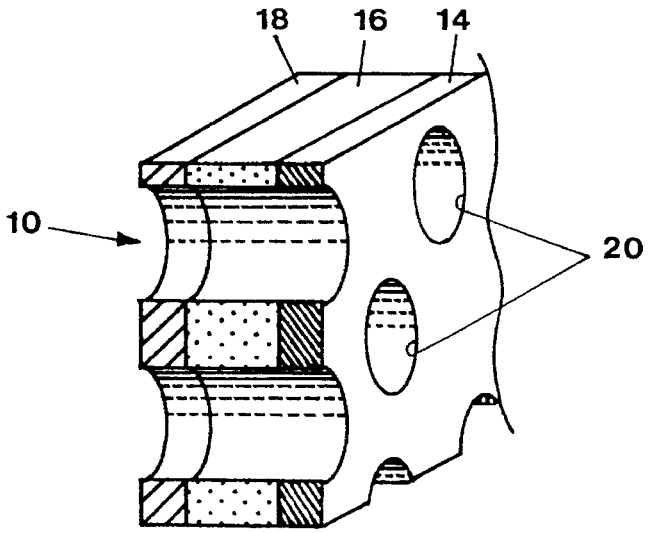
FIG. 6 is a an enlarged fragmentary perspective view of a one-way vision display panel constructed as a perforated plastic panel having a light-absorbing (or black) layer on one side surface and an image printed on or transferred to the opposite side surface.

FIG. 6 shows a cross-section view of the one-way vision image display panel 10 upon completion of the lamination process wherein the image or image layer 18 has been successfully transferred to the light-reflective layer or coating 16 without bleeding into or otherwise penetrating the through-holes 20.

Figure 7:
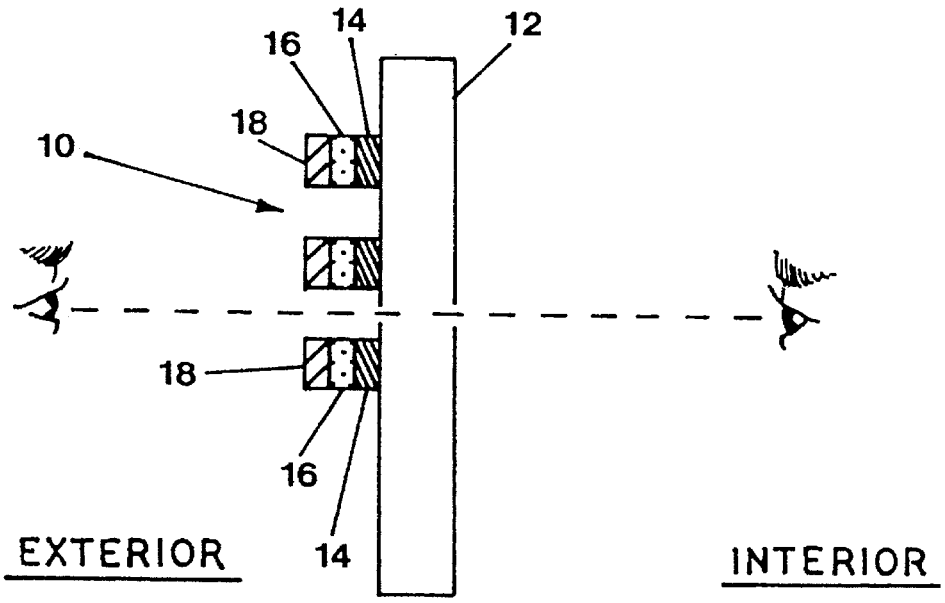
FIG. 7 is a transverse sectional view through the one-way vision display panel of FIG. 6 shown in use as an exterior mount panel.

FIG. 7 is a transverse sectional view through the one-way vision display panel 10 of FIG. 6 shown in use as an exterior mount panel wherein the light-absorbing layer 14 is disposed adjacent the exterior surface of the window 12. An adhesive (not shown) may be used to secure the solid bar portion of the light-absorbing layer 14 to the exterior surface of the window 12. Alternatively, the panel 10 may comprise static cling material, such as for example, static cling PVC film, or may comprise self-adhesive PVC film for adhearing to the window 12.

In the exterior mount panel 10 shown in FIG. 7, the image contained in the image layer 18 is clearly seen when viewing the panel 10 in the direction from left (exterior) to right (interior).

Figure 8:
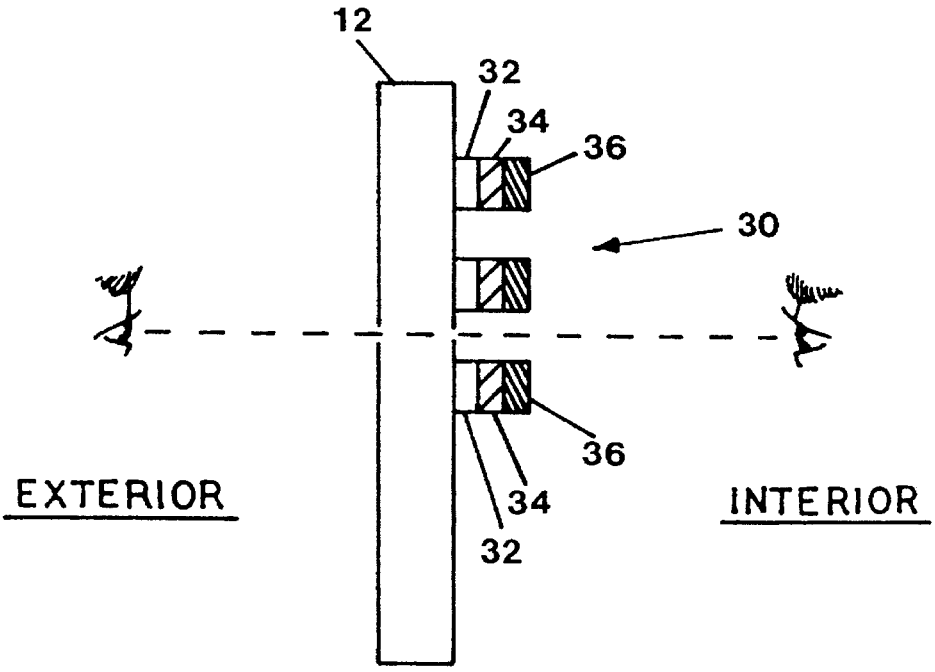
FIG. 8 is a transverse sectional view through a second embodiment for a one-way vision display panel shown in use as an interior mount panel.

FIG. 8 is a transverse sectional view through a second embodiment for a one-way vision display panel 30 shown in use as an interior mount panel wherein an image or image layer 34 is disposed between a clear or transparent layer 32 and a light-absorbing layer 36 which, as before, is preferably black in color. In this embodiment, the clear layer 32 is secured to the inside or interior surface of the window 12.

The method steps for transferring an image onto an interior mount panel 30 as shown in FIG. 8 are as follows.

First, an image is formed onto a transfer medium using the electrostatic printing process as described above. For example, the transfer medium may comprises paper sheet material treated with a toner receptive coating. In this case, the orientation of the image to be formed on the transfer medium is not a reverse image but rather is the desired true or correct image orientation that a viewer will see when viewing the completed interior mount display panel 30.

Next, a clear or transparent perforated membrane (i.e. clear layer 32) is prepared.

The true image printed on the transfer medium is then transferred as a reverse image layer 34 onto a surface of the clear or transparent perforated membrane (layer 32) by the heat and pressure lamination step described above in connection with FIG. 5.

The final step involves applying a dark, light-absorbing coating or layer 36 onto the exposed surface of the image layer 34. One way for applying the dark or light-absorbing coating would be by image transfer via the electrostatic ink deposition and lamination steps outlined above. Using this technique ensures that substantially no ink from either the light-reflective image layer or the light-absorbing layer will penetrate into the holes of the perforated membrane material.

However, it is found that the presence of black or similar light-absorbing ink in the holes of the perforated sheet material does not substantially effect the through vision properties of the display panel. Accordingly, the light-absorbing layer may be applied via a conventional liquid ink transfer process, such as by silk screen or similar litho process.

While I have illustrated and described the preferred embodiments of my invention, it is to be understood that these are capable of variation and modification. For example, while the electrostatic image transfer process of the present invention has been described by way of a example of a specific application to a perforated plastic sheet material, it is understood that the principles of the present invention are also applicable for applying images to display panels constructed from other types of perforated membrane materials including, but not limited to, perforated metal sheet, light and medium weight fabrics, etc. Further, while in the specific case of perforated plastic sheet material, both heat and pressure are desired for effecting a good image transfer, it is understood that either heat and/or pressure alone may be sufficient to effect adequate image transfer of a reverse image from the transfer medium onto the perforated membrane material depending upon the specific choice of perforated membrane material which is selected for use in the construction of the one-way vision display panel.

I therefore do not wish to be limited to the precise details set forth, but desire to avail ourselves of such changes and alterations as fall within the purview of the following claims.

I claim:

1. A method of producing an image onto a surface of a one-way vision display panel of the type which is constructed as a perforated membrane having an opaque light-reflective surface and a light-absorbing surface and whereby the image is clearly visible when viewing the display panel from one direction and wherein the perforated membrane permits substantially unobstructed through-viewing when viewing the display panel from a second, opposite direction, said method for substantially eliminating a corona effect of the image when the one-way vision display panel is viewed in the through-viewing direction, comprising the steps of:

a) electrostatically transferring ink onto a transfer medium as a reverse image for temporarily holding the reverse image for later transfer to a surface of a perforated membrane;

b) preparing a membrane having an opaque light-reflective surface and a light-absorbing surface, and wherein the membrane is perforated, being defined by a plurality of spaced through-holes separated by solid bar portions; and c) using pressure to transfer the reverse image from the transfer medium as a desired correctly oriented image onto only solid bar portions of the opaque light-reflective surface of the perforated membrane without any substantial image transfer into or through the through-holes such that the correctly oriented image is substantially undetectable when looking at the one-way vision display panel in the second, opposite through-viewing direction.

2. The method of claim 1 wherein the step of electrostatically transferring ink includes using powdered ink.

3. The method of claim 2 wherein:

a) the perforated membrane comprises plastic sheet material; and b) the step of using pressure to transfer the reverse image includes using heat to fuse the reverse image onto the solid bar portions of the perforated plastic sheet material.

4. The method of claim 3 wherein the transfer medium comprises paper sheet material.

5. The method of claim 1 wherein the step of electrostatically transferring ink includes using liquid ink.

6. The method of claim 5 wherein:

a) the perforated membrane comprises plastic sheet material; and b) the step of using pressure to transfer the reverse image includes using heat to fuse the reverse image onto the solid bar portions of the perforated plastic sheet material.

7. The method of claim 6 wherein the transfer medium comprises paper sheet material.

8. A method of applying an image onto a surface of a one-way vision display panel of the type which is constructed as a perforated plastic membrane having an opaque light-reflective surface and a light-absorbing surface and whereby the image is clearly visible when viewing the display panel from one direction and wherein the perforated plastic membrane permits substantially unobstructed through-viewing when viewing the display panel from a second, opposite direction, said method for substantially eliminating a corona effect of the image when the one-way vision display panel is viewed in the through-viewing direction, comprising the steps of:

a) electrostatically transferring toner onto a transfer medium as a reverse image for temporarily holding the reverse image for later transfer to a surface of a perforated plastic membrane;

b) preparing a plastic membrane having an opaque light-reflective surface and a light absorbing surface, and wherein the plastic membrane is perforated, being defined by a plurality of spaced through-holes separated by solid bar portions; and c) using heat and pressure to transfer the reverse image from the transfer medium as a desired correctly oriented image onto only solid bar portions of the opaque light-reflective surface of the perforated plastic membrane without any substantial image transfer into or through the through-holes such that the correctly oriented image is substantially undetectable when looking at the one-way vision display panel in the second, opposite through-viewing direction.

9. The method of claim 8 wherein the transfer medium comprises paper sheet material.

10. A method of producing an interior mount one-way vision display panel of the type which is constructed as a perforated transparent membrane including a light-reflective image layer and a light-absorbing layer and whereby the image layer is clearly visible when viewing the display panel from one direction and wherein the perforated membrane permits substantially unobstructed through-viewing when viewing the display panel from a second, opposite direction, said method for substantially eliminating a corona effect of the image layer when the one-way vision display panel is viewed in the through-viewing direction, comprising the steps of:

a) electrostatically transferring ink onto a transfer medium as an image for temporarily holding the image for later transfer to a surface of a perforated transparent membrane;

b) preparing a perforated transparent membrane having a first side surface for mounting to an interior surface of a window and a second side surface for receiving an image layer, said perforated transparent membrane being defined by a plurality of spaced through-holes separated by solid bar portions; and c) using pressure to transfer the image from the transfer medium as a reverse image layer onto only solid bar portions of the second side surface of the perforated transparent membrane without any substantial image transfer into or through the through-holes of the perforated transparent membrane;

d) applying a light-absorbing layer over the exposed side surface of the reverse image layer such that:

i) when the first side surface of the transparent perforated membrane is mounted on an interior surface of a window, the reverse image layer appears as a desired oriented image when looking at the window from a position outside the window; and ii) the reverse image layer is substantially undetectable when looking at the one-way vision display panel in a through-viewing direction from a position inside the window.

11. The method of claim 10 wherein the step of electrostatically transferring ink includes using powdered ink.

12. The method of claim 11 wherein:

a) the perforated transparent membrane comprises plastic sheet material; and b) the step of using pressure to transfer the image includes using heat to fuse the reverse image onto the solid bar portions of the perforated plastic sheet material.

13. The method of claim 12 wherein the transfer medium comprises paper sheet material.

14. The method of claim 10 wherein the step of applying a light-absorbing layer includes printing via a liquid ink process.

15. The method of claim 10 wherein the step of applying a light-absorbing layer includes the steps of:

a) electrostatically depositing ink of a light-absorbing color onto a second transfer medium; and b) using heat and pressure to transfer the ink deposited on the second transfer medium onto the exposed solid bar portions of the reverse image layer.

16. The method of claim 15 wherein the transfer medium comprises paper sheet material.

* * * * *

US005525177C1

(12) EX PARTE REEXAMINATION CERTIFICATE (6308th)

United States Patent

Ross

(10) Number: US 5,525,177 C1

(45) Certificate Issued: Jul. 22, 2008

(54) IMAGE TRANSFER METHOD FOR ONE WAY VISION DISPLAY PANEL

(75) Inventor: Gregory E. Ross, Santa Rosa, CA (US)

(73) Assignee: Clear Focus Imaging, Inc., Santa Rosa, CA (US)

Reexamination Request:
No. 90/007,831, Dec. 1, 2005

Reexamination Certificate for:

| | |
|---|---|
| Patent No.: | **5,525,177** |
| Issued: | **Jun. 11, 1996** |
| Appl. No.: | **08/299,500** |
| Filed: | **Sep. 1, 1994** |

(51) Int. Cl.

| | |
|---|---|
| ***B44C 1/017*** | (2006.01) |
| ***B44F 1/10*** | (2006.01) |
| ***B44F 1/00*** | (2006.01) |

(52) U.S. Cl. ..... 156/240; 156/230; 156/235; 156/277; 156/249; 40/615; 40/591

(58) Field of Classification Search ..... None
See application file for complete search history.

(56) References Cited

U.S. PATENT DOCUMENTS

| | | | |
|---|---|---|---|
| 4,358,488 | A | 11/1982 | Dunklin |
| 4,673,609 | A | 6/1987 | Hill |
| 4,883,556 | A | 11/1989 | Leavitt, Sr. |
| 4,955,709 | A | 9/1990 | Smith |
| 5,045,391 | A | 9/1991 | Brandt |
| 5,106,710 | A | 4/1992 | Wang |
| 5,108,865 | A | 4/1992 | Zwaldo |
| 5,247,334 | A | 9/1993 | Miyakawa |
| 5,262,259 | A | 11/1993 | Chou |
| 5,525,177 | A | 6/1996 | Ross |
| 5,609,938 | A | 3/1997 | Shields |
| 5,773,110 | A | 6/1998 | Shields |
| RE37,186 | E | 5/2001 | Hill |

FOREIGN PATENT DOCUMENTS

| | | |
|---|---|---|
| EP | 0 437 073 A2 | 7/1991 |
| FR | 2 693 950 | 1/1994 |
| GB | 2 088 613 A | 6/1982 |
| GB | 2 244 585 | 12/1991 |
| JP | 51-86049 | 7/1976 |
| JP | 54-93255 | 7/1979 |

OTHER PUBLICATIONS

3M Scotchprint™ Graphics "Panoramic Graphics promote Chase Plaza during Construction", 1992.
3M Scotchprint™ Electronic Graphics System, 1993.
3M, 3M Scotchprint™ Operator's Manual, Aug. 1993.

(Continued)

*Primary Examiner*—Jerry D. Johnson

(57) ABSTRACT

A method of producing an image onto a surface of a one-way vision display panel of the type which is constructed as a perforated membrane having an opaque light-reflective surface and a light-absorbing surface and whereby the image is clearly visible when viewing the display panel from one direction and wherein the perforated membrane permits substantially unobstructed through-viewing when viewing the display panel from a second, opposite direction. The method substantially eliminates the corona effect of the image while viewing the display panel in the through-viewing direction, the corona effect being the result of stray ink which has traveled from the image layer into the through-holes of the perforated membrane during the image printing process. The method includes the steps of: electro-statically transferring ink onto a transfer medium as a reverse image for temporarily holding the reverse image for later transfer to a surface of a perforated membrane; and transferring the reverse image from the transfer medium using heat and/or pressure in order to form a desired correctly oriented image onto only the solid bar portions of a surface of a perforated membrane without any substantial image transfer into or through the through-holes of the perforated membrane such that the correctly oriented image is substantially undetectable when looking at the one-way vision display panel in the second, opposite through-viewing direction.

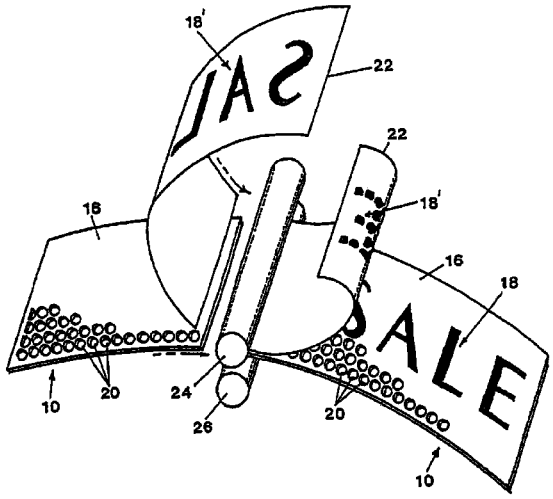

OTHER PUBLICATIONS

3M Scotchprint™ "Wear Coat and Image Transfer Media", Product Bulletin 8603/8604W, Release B, Effective Aug. (1994).

3M Scotchprint™ "Wear Coat and Image Transfer Media", Series 8603, 8604RW, 3M (1994).

3M Scotchprint™ Product and Service Directory, pp. 273 and 274, 1997–98.

Scotchprint™ Graphics Help Mervyn's Become the "Freshest Face in Florida".

ImagoImage, Inc., ImagoImage, Inc. brochure, Aug. 1993.

"New Graphics System . . . " Sign News and Screen Printing, Nov./Dec. 1990.

"Rolling L.A. billboard . . . " Long Beach Press—Telegram, Aug. 11, 1993.

"Hey! Hollywood Megahits Roll Down" The Christian Science Monitor, Aug. 17, 1993.

Shadow Screen Co, Inc. "Shadow Screens", 1979 Catalog.

"American Scenics" Brochure , revised in 1978.

Gila River Products, Inc., "GILA™ Automotive Products", undated.

Kathleen Sullivan, "San Francisco Examiner", Mar. 5, 1993.

3m instruction Bulletin 4.7. Release B, 1991.

"The Scotchprint™ Electronic Graphics System from 3M," 1991.

"Scotchprint™ Electronic Graphics System", 3M 1991.

Product Bulletin 8000, "Scotchprint™ Electronics Graphics System", 3M, Oct. 1991

Product Bulletin 8600, "Scotchprint™ Series 8600 Marketing Film", 3M, Sep. 1992.

3M Scotchprint™ Graphics "Huge Scotchprint Graphics Draw Fans to Hockey Games", 1992.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *